United States Patent [19]

Haverkamp

[11] Patent Number: 4,964,783

[45] Date of Patent: Oct. 23, 1990

[54] DEVICE FOR EMPTYING A LIQUID-COLLECTION TANK IN A WATER-CONDUCTING HOUSEHOLD APPLIANCE

[75] Inventor: Hans Haverkamp, Oerlinghausen, Fed. Rep. of Germany

[73] Assignee: Hanning Electro-Werke GmbH & Co., Oerlinghausen, Fed. Rep. of Germany

[21] Appl. No.: 266,117

[22] Filed: Nov. 2, 1988

[30] Foreign Application Priority Data

Apr. 20, 1988 [DE] Fed. Rep. of Germany ... 8805234[U]

[51] Int. Cl.[5] ..... F04D 29/00

[52] U.S. Cl. ..... 415/52.1; 415/58.2; 415/119

[58] Field of Search ..... 415/52.1, 58.2, 58.6, 415/119, 121.2

[56] References Cited

U.S. PATENT DOCUMENTS

| | | | |
|---|---|---|---|
| 2,400,434 | 5/1946 | Nelson | 415/11 |
| 2,874,642 | 2/1959 | Forrest | 415/52.1 |
| 3,238,534 | 3/1966 | Hartland | 415/53 R |
| 3,286,639 | 11/1966 | Hutton | 415/53 R |
| 3,730,646 | 5/1973 | Affri et al. | 415/53 R |

FOREIGN PATENT DOCUMENTS

| | | | |
|---|---|---|---|
| 114329 | 4/1929 | Fed. Rep. of Germany | 415/53 R |
| 750326 | 8/1933 | France | 415/53 R |
| 1101771 | 10/1955 | France | 415/53 R |

*Primary Examiner*—John T. Kwon

*Attorney, Agent, or Firm*—Max Fogiel

[57] ABSTRACT

An arrangement for emptying a liquid collection tank in household appliances that use water such as washing machines or dish washers. A centrifugal pump is provided with a housing and a floating impeller. An axial suction connection with a tubular connector extends out of the liquid collection tank which is provided on the appliance. The liquid conveyed by the pump is diverted by a radial delivery connection on the housing. A recirculation channel is connected between one end of the radial delivery connection and the suction connection of the pump, for the purpose of diverting liquid that is conducted into the vicinity of the suction connection and empties into the tubular connector. This recirculation channel has a cross-section corresponding to the delivery connection and the cross-section of the suction connection. The recirculation channel, furthermore, is shaped into the housing in the form of an open gap toward the impeller, and has a pressure difference between its ends for circulating liquid in the pump housing to eliminate noise effects in the pump, and to prevent foreign matter from depositing in the recirculation channel and clogging that channel.

4 Claims, 2 Drawing Sheets

Figure 1:
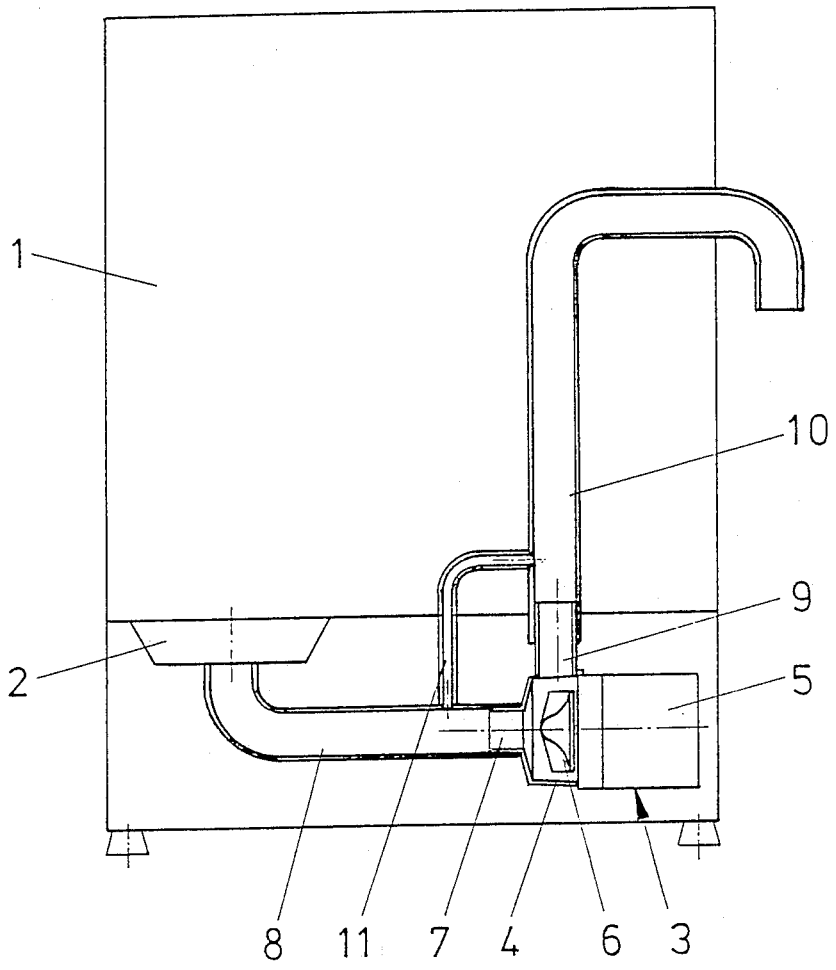

11
9
7
4
12
5

14
9
13
7
4
6
5

DEVICE FOR EMPTYING A LIQUID-COLLECTION TANK IN A WATER-CONDUCTING HOUSEHOLD APPLIANCE

The invention concerns a device for emptying a liquid-collection tank in a water-conducting household appliance such as a washing machine or dish washer and consisting of a centrifugal pump with a housing that accommodates a floating impeller and has an axial suction connection with a connector in the form of a pipe or hose that extends out of the liquid-collection tank mounted on it and a radial delivery connection for diverting the liquid conveyed by the centrifugal pump mounted on it.

The centrifugal pumps employed in devices of this type are always low-output, are usually powered by split-pole motors, and are designed to be resistant to contamination, lint, dirt, and foreign matter. Since, moreover, it is now generally attempted to keep machinery, especially in the case of household appliances, as quiet as possible, the pumps that empty the appliances are included in the process of noise minimization. Refinements in bearing technology and in the design of both electric and magnetic motors have recently made it possible to construct pumps of this type quiet enough to satisfy the desired operating behavior during the normal evacuation process.

What continues to be a problem, however, is noise that does not occur until the liquid-collection tank has been emptied and that is called "snorkeling" in the field. This periodically occurring noise is louder than the usual noise of the machinery and is especially unpleasant because it swells up and down, a situation that is perceived as especially stressful.

Snorkeling can be ascribed to the conditions that will now be described. Once the liquid-collection tank has been pumped dry, air is suctioned in by the pump and arrives in the housing. At this point in time there is a column of water above the still rotating pump impeller in the length of hose that communicates with the delivery connection. With the air in the pump housing, gravity forces the column of water back into the housing, where it arrives in the vicinity of the impeller, which intercepts it and pumps it back into the hose, at which the water penetrates downward again and into the housing. These alternating pumping processes, which are associated with considerable noise, also occasion an oscillating motion on the part of the pump shaft, whereby both the shaft and the rotor move back and forth axially to the extent that the bearing's play will allow. The result is even more noise on top of the snorkeling.

Attempts have been made to solve the problem by using various types and distributions of hose as well as thicker or thinner hoses. Filtering chambers in the form of antechambers have also been provided in the pump housing. All of these measures, however, have been unsuccessful, and even decreasing or eliminating the axial play in the motor bearing has been fruitless.

The object of the invention is accordingly to provide a device for emptying a liquid-collection tank in a water-conducting conducting household appliance whereby the occurrence of undesirable snorkeling and motor noise is effectively eliminated by simple means.

The measures proposed to attain the aforesaid object will be evident from the claims.

The recirculation channel that connects the delivery end of the centrifugal pump to its suction end in accordance with the invention produces circulation in the pump housing once the liquid-collection tank has been pumped dry that eliminates the previous fluctuations in pressure and periodic oscillations. The simultaneous but very slight reduction in the output of the pump is negligible in practice and is far outweighed by the resulting advantage of decreased noise.

Figure 2:
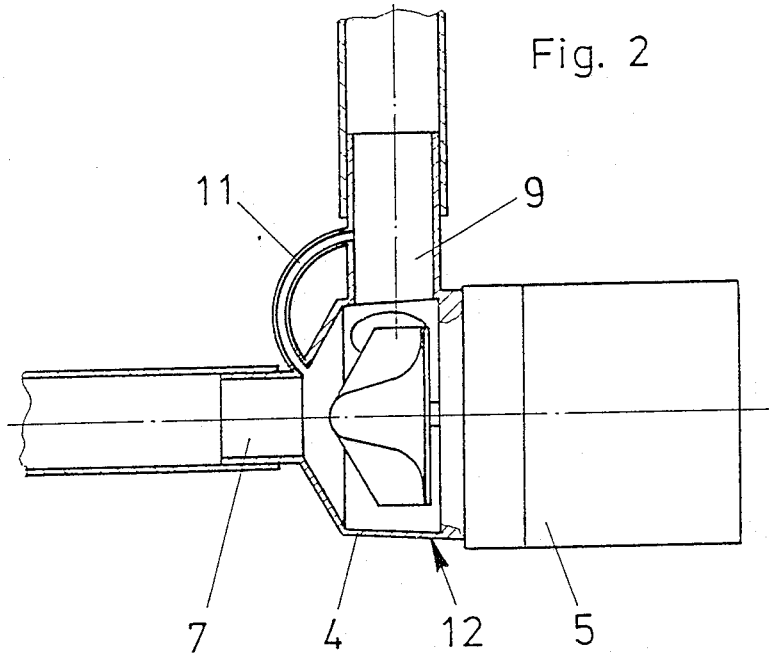
Figure 3:
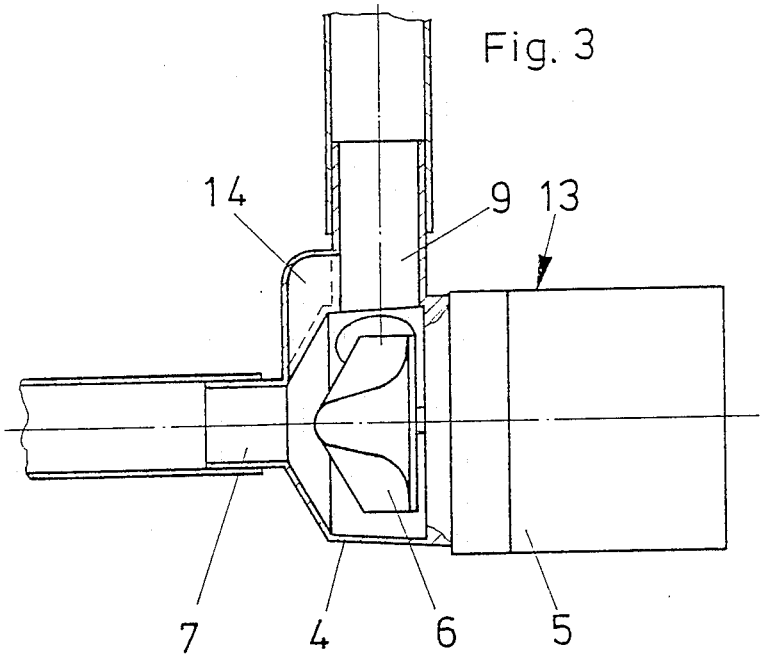

Embodiments of the invention will now be described with reference to the drawings, wherein FIG. 1 is a schematic section through an emptying device in accordance with the invention installed in a water-conducting household appliance and FIGS. 2 and 3 are larger-scale illustrations of two other similar devices.

The water-conducting household appliance 1 illustrated in FIG. 1 has a liquid-collection tank 2 that is periodically emptied as necessary by a centrifugal pump 3. The pump has a housing 4 that accommodates a floating impeller 6 powered by an electric motor 5. The axial suction connection 7 to pump housing 4 communicates with liquid-collection tank 2 by way of a connector 8 in the form of a pipe or hose. Mounted on a radial delivery connection 9 is a section 10 of hose that diverts the liquid conveyed by centrifugal pump 3.

In accordance with the major characteristic of the invention, a recirculation channel 11 in the form of a section of hose with a smaller cross-section extends from the section 10 of hose mounted on delivery connection 9 into the vicinity of suction connection 7, where it empties into connector 8. The recirculation channel 11 extending from delivery connection 9 to suction connection 7 creates, due to the difference between the pressure at suction connection 7 and that at delivery connection 9, circulation of the liquid in pump housing 4 that eliminates the causes of the previous noise in centrifugal pump 3.

The centrifugal pumps 12 and 13 are basically similar in design to the just described centrifugal pump 3 with the exception of pump housing 4, which differs from that illustrated in FIG. 1 in that recirculation channel 11 is integrated into it in both cases. The channel 11 illustrated in FIG. 2 extends from delivery connection 9 to suction connection 7 in the arc of a circle in such a way that it can be manufactured in one piece with 4 by means of a core that rotates in the mold.

Recirculation channel in FIG. 3, differing from the one illustrated in FIG. 2 in that it is shaped into pump housing 4 in the form of a gap 14 that opens radially toward impeller 6. The advantages of this design are not only that pump housing 4 is simple to manufacture but that it absolutely prevents foreign matter from depositing in recirculation channel 14.

Other possible designs for recirculation channel 11 that employ the basic theory of the invention are also conceivable and are accordingly within its scope.

I claim:

1. An arrangement for emptying a liquid collection tank in a water-conducting household appliance such as a washing machine or dish washer, comprising: a centrifugal pump with a housing holding a floating impeller; a liquid collection tank on said alliance; an axial suction connection with a tubular connector extending out of said liquid collection tank and to said housing; a radial delivery connection on said housing for diverting liquid conveyed by said pump; a recirculation channel communicating at one end with said radial delivery connection and extending into said suction connection at another end for diverting liquid conveyed into the vicinity of said suction connection and emptying into said tubular connector; said recirculation channel having a cross-section of said delivery connection and the cross-section of said suction connection; said recirculation channel being shaped into said housing in form of a substantially narrow gap that open radially toward said impeller; said recirculation channel having a pressure difference between said one end and said other end for circulating liquid in said pump housing to eliminate noise effects in said centrifugal pump; said open gap preventing also foreign matter from depositing in said recirculation channel and clogging said channel.

2. An arrangement as defined in claim 1, wherein said tubular connector comprises a pipe.

3. An arrangement as defined in claim 1, wherein said tubular connector comprises a hose.

4. An arrangement as defined in claim 1, including a hose mounted on said delivery connection.

* * * * *